US007571924B2

(12) United States Patent
White

(10) Patent No.: US 7,571,924 B2
(45) Date of Patent: Aug. 11, 2009

(54) ROTATABLE SNOWBOARD BOOT BINDING APPARATUS

(76) Inventor: Rick White, P.O. Box 2100, Woodland, WA (US) 98674

( * ) Notice: Subject to any disclaimer, the term of this patent is extended or adjusted under 35 U.S.C. 154(b) by 334 days.

(21) Appl. No.: 11/453,466

(22) Filed: Jun. 14, 2006

(65) Prior Publication Data

US 2007/0290463 A1 Dec. 20, 2007

(51) Int. Cl.
*A63C 9/02* (2006.01)

(52) U.S. Cl. ..... 280/618; 280/611

(58) Field of Classification Search ..... 280/617, 280/618, 611, 607, 14.24
See application file for complete search history.

(56) References Cited

U.S. PATENT DOCUMENTS

| | | | | |
|---|---|---|---|---|
| 4,728,116 | A | 3/1988 | Hill | |
| 5,021,017 | A | 6/1991 | Ott | |
| 5,028,068 | A | 7/1991 | Donovan | |
| 5,044,654 | A | 9/1991 | Meyer | |
| 5,054,807 | A | 10/1991 | Fauvet | |
| 5,236,216 | A | 8/1993 | Ratzek | |
| 5,261,689 | A | 11/1993 | Carpenter et al. | |
| 5,277,635 | A | 1/1994 | Gillis | |
| 5,354,088 | A * | 10/1994 | Vetter et al. | 280/618 |
| D357,296 | S | 4/1995 | Sims | |
| 5,499,837 | A | 3/1996 | Hale et al. | |
| 5,584,492 | A | 12/1996 | Fardie | |
| 5,586,779 | A | 12/1996 | Dawes et al. | |
| 5,667,237 | A * | 9/1997 | Lauer | 280/607 |
| 5,669,630 | A | 9/1997 | Perkins et al. | |
| 5,713,587 | A * | 2/1998 | Morrow et al. | 280/14.21 |
| 5,762,358 | A | 6/1998 | Hale | |
| 5,782,476 | A | 7/1998 | Fardie | |
| 5,791,678 | A * | 8/1998 | Perlman | 280/618 |
| 5,820,155 | A * | 10/1998 | Brisco | 280/607 |
| 5,868,416 | A | 2/1999 | Fardie | |
| 5,975,554 | A | 11/1999 | Linton | |
| 5,984,325 | A | 11/1999 | Acuna | |
| RE36,800 | E | 8/2000 | Vetter et al. | |
| 6,102,430 | A | 8/2000 | Reynolds | |
| 6,155,578 | A * | 12/2000 | Patterson | 280/14.24 |
| 6,203,051 | B1 | 3/2001 | Sabol | |
| 6,206,402 | B1 | 3/2001 | Tanaka | |
| 6,290,423 | B1 * | 9/2001 | Jungkind | 403/322.1 |
| 6,315,305 | B1 * | 11/2001 | Gien | 280/14.24 |
| 6,318,749 | B1 | 11/2001 | Eglitis et al. | |
| 6,575,490 | B1 * | 6/2003 | Laughlin | 280/618 |
| 6,575,498 | B2 | 6/2003 | White | |
| 6,722,688 | B2 * | 4/2004 | Poscich | 280/618 |
| 6,910,707 | B1 * | 6/2005 | Lyng | 280/618 |
| 7,232,147 | B2 * | 6/2007 | Couderc | 280/623 |
| 7,316,412 | B2 * | 1/2008 | Couderc | 280/617 |

* cited by examiner

*Primary Examiner*—Christopher P Ellis
*Assistant Examiner*—John D. Walters
(74) *Attorney, Agent, or Firm*—Rylander & Associates PC; Kurt M. Rylander; Mark E. Beatty

(57) ABSTRACT

A rotatable snowboard boot binding includes a boot plate with a toe end, a heel end, an aperture, and a cutout, a vertical support connected to the boot plate, a boot binder, an engaging plate, with a top portion with a perimeter edge, a bottom portion, and attachment holes, where the bottom portion includes a perimeter edge with engagement slots and the top portion perimeter edge overhangs the bottom portion perimeter edge, and a latching device fitting moveably within the cutout in the boot plate and engageable with one or more engagement slots in the engaging plate.

25 Claims, 3 Drawing Sheets

ROTATABLE SNOWBOARD BOOT BINDING APPARATUS

FIELD OF THE INVENTION

The present invention relates to snowboard bindings, and more particularly to rotatable snowboard boot bindings with release mechanisms allowing a snowboarder to rotate the snowboard binding without the snowboarder having to release her boot from the binding.

BACKGROUND

Snowboarding is a popular winter sport. Snowboarders board down a snow covered mountain on a snowboard with boots affixed in snowboard bindings.

Two types of bindings are commonly used in snowboarding: the high-back strapped binding and a strapless step-in binding. The high-back strapped binding is characterized by a vertical plastic back piece which is used to apply pressure to the heel-side of the board. This binding has two straps which go over the foot, with one strap holding down the heel and the other holding down the toe. Some high-backs also have a third strap on the vertical back piece called a shin strap which gives additional support and aids in toe side turns. The strapless step-in binding is used with a hard shell boot much like a ski binding except it is non-releasable. With both types of bindings, a typically bottom plate or boot plate is provided with screw holes to attach the binding to a snowboard. The bindings are attached to the snowboard with four screws inserted in these screw slots.

Snowboard boot bindings are normally screwed onto the snowboard in a permanent orientation which is almost perpendicular to the direction of travel of the snowboard. When a snowboarder reaches the bottom of a run, the rear boot is typically released from its binding to allow the snowboarder to propel himself forward across relatively flat snow. Because the front foot in the snowboard binding is at an angle to forward motion, the snowboarder experiences discomfort and tension on his leg, knee, and foot joints. Having the front boot nearly perpendicular to the snowboard with the snowboard and back foot moving straight forward is very uncomfortable and potentially dangerous because a fall in this orientation may injure the ankle or knee joints of the snowboarder. If the snowboarder releases his front boot from the binding, the snowboarder is relegated to walking, carrying his board. Further more it is difficult to mount a chair lift with one foot on the board at an angle to the forward direction of the board, and on a chair lift having the foot nearly perpendicular to the snowboard causes the snowboard to be positioned across the front of the chair which is an awkward orientation for mounting and is disturbing or damaging to anyone seated on an adjacent chair.

The use of rotatable boot binding mechanisms is known in the prior art. More specifically, rotatable boot binding mechanisms heretofore devised and utilized for the purpose of allowing rotation of a boot binding with respect to a snowboard are known to consist basically of familiar, expected and obvious structural configurations, notwithstanding the myriad of designs encompassed by the crowded art which have been developed for the fulfillment of countless objectives and requirements. A number of devices have provided rotatable snowboard bindings, but lack the improved performance and ease of adjustability of the present invention.

Thus, there is a need for a rotatable snowboard boot binding which allows snowboarders to rotate their foot without removing their boot from its binding, allows rotation without the need to bend down to operate a latching device, provides improved responsiveness, provides enhanced foot and lower leg support, and is easily retrofitted to existing snowboards.

The following represents a list of known related art:

| Reference: | Issued to: | Date of Issue: |
|---|---|---|
| U.S. Pat. No. 6,575,498 B1 | White | Jun. 10, 2003 |
| U.S. Pat. No. 6,318,749 | Eglitis et al. | Nov. 20, 2001 |
| U.S. Pat. No. 6,206,402, | Tanaka | Mar. 27, 2001 |
| U.S. Pat. No. 6,203,051 | Sabol | Mar. 20, 2001 |
| U.S. Pat. No. 6,155,578 | Patterson | Dec. 5, 2000 |
| U.S. Pat. No. 6,102,430 | Reynolds | Aug. 15, 2000 |
| U.S. Pat. No. 5,984,325 | Acuna | Nov. 16, 1999 |
| U.S. Pat. No. 5,975,554 | Linton | Nov. 2, 1999 |
| U.S. Pat. No. 5,868,416 | Fardie | Feb. 9, 1999 |
| U.S. Pat. No. 5,782,476 | Fardie | Jul. 21, 1998 |
| U.S. Pat. No. 5,762,358 | Hale et al. | Jun. 9, 1998 |
| U.S. Pat. No. 5,669,630 | Perkins et al. | Sep. 23, 1997 |
| U.S. Pat. No. 5,586,779 | Dawes et al. | Dec. 24, 1996 |
| U.S. Pat. No. 5,584,492 | Fardie | Dec. 17, 1996 |
| U.S. Pat. No. 5,499,837 | Hale et al. | Mar. 19, 1996 |
| U.S. Pat. No. 5,354,088 | Vetter et al. | Oct. 11, 1994 |
| U.S. Pat. No. 5,277,635 | Gillis | Jan. 11, 1994 |
| U.S. Pat. No. 5,236,216 | Ratzek | Aug. 17, 1993 |
| U.S. Pat. No. 5,261,689 | Carpenter et al. | Nov. 16, 1993 |
| U.S. Pat. No. 5,054,807 | Fauvet | Oct. 8, 1991 |
| U.S. Pat. No. 5,044,654 | Meyer | Sep. 3, 1991 |
| U.S. Pat. No. 5,028,068 | Donovan | Jul. 2, 1991 |
| U.S. Pat. No. 5,021,017 | Ott | Jun. 4, 1991 |
| U.S. Pat. No. 4,728,116 | Hill | Mar. 1, 1988 |
| U.S. Pat. No. Re. 36,800 | Vetter et al. | Oct. 11, 1994 |
| U.S. Des. Pat. 357,296 | Sims | Apr. 11, 1995 |

The teachings of each of the above-listed citations (which does not itself incorporate essential material by reference) are herein incorporated by reference. None of the above inventions and patents, taken either singularly or in combination, is seen to describe the instant invention as claimed.

U.S. Pat. No. 6,575,498 B1 to White, the present applicant, teaches a conversion kit providing a rotating base plate to which a conventional snowboard boot binding apparatus may be attached. White does not teach the use of rotatable mechanism integral with a boot binding, which reduces complexity, saves weight, and provides a tighter attachment to the board for more natural response in maneuvers.

U.S. Pat. No. 5,984,325 to Acuna teaches an adjustable snowboard binding. In the reference the foot remains in the binding, and binding can be locked into a selected angular position using one or more hand manipulated levers. The boot binding itself is the rotation device. Boot must be unstrapped and removed to adjust the position. The boot holding device is built into the disclosed binding—the boot is inserted the binding.

U.S. Pat. No. 6,155,578 to Patterson discloses a snowboard latching mechanism which requires the snowboarder to bend over and with both hands to radially pull outward on handles of boot binding to remove element from notches in binding, and then to rotate the device.

U.S. Pat. No. 6,102,430, to Reynolds discloses a latching mechanism for a snowboard boot binding, wherein the snowboarder bends down and releases a lever which allows the foot in the boot in the binding to be moved angularly in relation to the snowboard.

U.S. Pat. No. 6,206,402, to Tanaka discloses a latching mechanism for a snowboard boot binding in which the boot must be removed, and then the twist locking mechanism manually operated to rotate the binding to desired rotation settings, and then the boot is reinserted.

U.S. Pat. No. 5,586,779, to Dawes et al. teaches a latching mechanism for a snowboard boot binding which includes a screw locking mechanism wherein the screw is screwed into the threaded hole in the binding mount plate, and the mechanism consists of a centrally disposed spring loaded plunger. Dawes claims an adjustable snowboard boot binding apparatus which is rotatably adjustable "on the fly" without removing the boot from the binding and is compatible with existing snowboard boot bindings. A central hub is attached to the board and a top binding mounting plate and bottom circular rotating plate are interconnected and sandwich the hub between them, so that the binding plate and circular plate rotate on a bearing between the binding plate and the central hub. A spring-loaded plunger lock mechanism locks the binding plate to the central hub in a series of holes in the hub. Alternately, gear teeth on the hub may interact with a plunger to lock the device. Several other locking devices are shown.

U.S. Pat. No. 5,028,068, to Donovan describes a quick-action adjustable snowboard boot binding comprising a support plate to which a conventional boot binding is mounted. The support plate is fixedly attached to a circular swivel plate which rotates, via a center bearing, relative to a base plate attached to the board. Donovan discloses a latching mechanism for a snowboard boot binding in which a handle is pivotally mounted on a bracket which is connected to a yoke, which is attached to a flexible cable which, when tightened, prevents the binding from moving. The handle is mounted on a plate below the boot binding. A person must bend down and loosen, and bend down and tighten. A cable encircles a groove in the swivel plate and a handle pivots up to release the cable for adjusting the angle of the swivel plate and pivots down to tighten the swivel plate at a desired angle.

U.S. Pat. No. 6,318,749, issued to Eglitis et al. teaches a latching mechanism for a snowboard boot binding to allow the snowboarder to align his boot with the direction of travel. The snowboarder must bend down and manually grasp a pull ring under the binding and pull outwardly, compressing a spring in the latching mechanism until the locking member disengages from a locking notch.

U.S. Pat. No. 5,975,554 issued to Linton discloses a latching mechanism for a snowboard boot binding to allow a snowboarder to rotate his boot in relation to the snowboard. The disclosed device utilizes a cable around an outer surface of a floating clamp. A specific boot binding must be used. The cable operates through use of a lever. The snowboarder must bend down to flip the lever to engage or disengage.

U.S. Pat. No. 5,669,630, issued to Perkins et al. discloses a latching mechanism for a snowboard boot binding to allow a snowboarder to rotate the boot binding relative to the snowboard. The latching mechanism works through a tie down bolt that must be unscrewed to allow rotation of the boot binding relative to the board. Rotation is done without the foot in the binding.

U.S. Pat. No. Re. 36,800, to Vetter et al. discloses a latching mechanism for releasing a boot binding from a board. The reference discloses bending over and manually lifting up a latch bind held under a spring bias, rotating the foot, and thus disengaging from the board. The reference discloses a quick release for the back foot.

U.S. Pat. No. 5,354,088 to Vetter et al. discloses a coupling for releasably mounting a boot with boot binding to a turntable ring which is adjustably secured to a snowboard. A spring loaded pin with a long cord is the locking mechanism. Vetter does not disclose a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,762,358 to Hale et al. discloses a latching mechanism for a snowboard boot binding to allow a snowboarder to rotate his boot while bound to the snowboard, in relation to the snowboard. The reference teaches a base plate, a binding plate, and a hold down disk, wherein the binding plate swivels in relation to the snowboard, the base plate and the hold down disk. A dual lever system is provided on the binding plate, on either side of the boot binding, the rotation of the levers engages and disengages a locking element which engages and disengages the binding plate to effectuate the rotatabilty.

U.S. Pat. No. 5,499,837 to Hale et al. illustrates a swivelable mount for a snowboard having a rotatable binding plate attached to a circular plate which rotates in a circular groove of a base plate secured to the snowboard. A handle with a cam and spring-loaded pin secures the binding plate at a desired angle. Hale does not disclose a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 6,203,051 issued to Sabol discloses a latching mechanism for a snowboard boot binding that allows the snowboarder to rotate the binding in relation to the snowboard. The reference teaches a T-handle screw-type lock which can be secured in the up or down position, an elevated lock ring to prevent icing, and a control guide post for ease of alignment. The snowboarder in operation must bend down and grab the "T" shaped lock handle to change the degree of rotation.

U.S. Pat. Nos. 5,584,492, 5,782,476, and 5,868,416, issued to Fardie disclose a latching mechanism for a snowboard boot binding that allows the snowboarder to rotate the binding in relation to the snowboard. Single or dual levers are actuated to allow rotatability, and to secure the binding from rotation. The levers actuate a band which slides into and out of toothed segments in the binding platform. Fardie provides an adjustable snowboard binding assembly which can be rotatably controlled. The snowboard mounting platforms each have a plurality of inwardly facing radial teeth along the circumference of a centralized circular cutout, the bottom of which rests on four quadrant segments connected to a stainless steel band which moves along a groove in the center of the board activated by a lever. The mounting platform can rotate relative to the four quadrant segments and is locked in place at a desired angle by two spring loaded sliding segments with mating teeth to engage the teeth on the mounting platform to lock it in place at a desired angle.

U.S. Pat. No. 5,236,216 to Ratzek shows a fastening disk that can be clamped upon a binding-support plate that can be turned about a normal axis to the board. Several bolts must be loosened somewhat to allow the rotational position of the binding plate to be changed, then the bolts must be re-tightened.

U.S. Pat. No. 5,261,689 to Carpenter et al. shows a number of bolts through a hold-down plate for a rotatable binding-support plate must be loosened and then re-tightened in order to change the binding orientation.

U.S. Pat. No. 5,044,654 to Meyer shows a system in which a single central bolt must be loosened and re-tightened.

U.S. Pat. No. 5,277,635 to Gillis shows a water skiboard with rotatably adjustable bindings; however, it appears that such mechanism is not adequate for use in the snowboarding environment. It is also noted that the above-mentioned prior devices in their structure and design, do not lend themselves to relatively inexpensive, lightweight, low-profile, bindings mounts that are desirable by those enthusiasts who desire to enhance their snowboarding performance capabilities.

U.S. Pat. No. 5,499,837 to Hale et al. shows an improved snowboard binding support with quick and effective swivelable adjustment capability; however, there remains a need for such a product that has unique structural features that will lend it to easy and efficient fabrication as well as having superior strength, durability, and reliability in the face of the high stresses encountered during normal rigorous use of a snowboard.

Thus, while the foregoing body of art indicates it to be well known to have an adjustable snowboard binding, the art described above does not teach or suggest a rotatable boot binding which has the following combination of desirable features: (1) the snowboarder may use the boot binding with commonly available boot sizes; (2) the snowboarder may rotate the boot binding without removing the boot; (3) the snowboarder may rotate the boot binding without bending down by utilizing a tether which can attach to the leg; (4) the rotatable boot binding may be easily retrofitted to any snowboard; (5) no special tools or skills are required to attach the rotatable boot binding to a snowboard; (6) the rotatable boot binding is simple to manufacture; (7) the stiffness and response of the rotatable boot binding may be altered by altering the shape and stiffness of the engaging plate and/or a calf support; (8) a replaceable low friction pad may be incorporated to prevent damage to the snowboard from contact with the bottom of the boot plate.

SUMMARY AND ADVANTAGES

A rotatable snowboard boot binding includes a boot plate with a toe end, a heel end, an aperture, and a cutout, a vertical support connected to the boot plate, a boot binder, an engaging plate, with a top portion with a perimeter edge, a bottom portion, and attachment holes, where the bottom portion includes a perimeter edge with engagement slots and the top portion perimeter edge overhangs the bottom portion perimeter edge, and a latching device fitting moveably within the cutout in the boot plate and engageable with one or more engagement slots in the engaging plate. A rotatable snowboard boot binding may incorporate a tether attached to the latching device for operating the latching device. A rotatable snowboard boot binding may include calf supports. A rotatable snowboard boot binding may include a soft plastic pad between the boot plate and the snowboard to reduce friction and prevent scratching, made from self-lubricating polymers such as acetyl resin and nylon, or high molecular weight polyethylene (UHMWPE), ultra-high molecular weight polyethylene (UHMWPE), or polytetrafluoroethylene (PTFE) and its derivatives. The latching device may include a latch key fitting slidably within the cutout in the boot plate with at least one tooth for engaging the engagement slots in the engaging plate, a pin, spring means for positively seating the latch key using spring force, and connecting means for connecting the latch key to the pin, wherein displacing the pin causes the latch key to slidingly disengage from the engagement slots, thereby deforming the spring means, and then releasing the pin allows the latch key to reengage the engagement slots due to spring force. A rotatable snowboard boot binding may be combined with a snowboard.

The rotatable snowboard boot binding of the present invention presents numerous advantages, including: (1) the snowboarder may use the boot binding with commonly available boot sizes; (2) the snowboarder may rotate the boot binding without removing the boot; (3) the snowboarder may rotate the boot binding without bending down by utilizing a tether which can attach to the leg; (4) the rotatable boot binding may be easily retrofitted to any snowboard; (5) no special tools or skills are required to attach the rotatable boot binding to a snowboard; (6) the rotatable boot binding is simple to manufacture; (7) the stiffness and response of the rotatable boot binding may be altered by altering the shape and stiffness of the engaging plate and/or a calf support; (8) a replaceable low friction pad may be incorporated to prevent damage to the snowboard from contact with the bottom of the boot plate.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Figure 1:
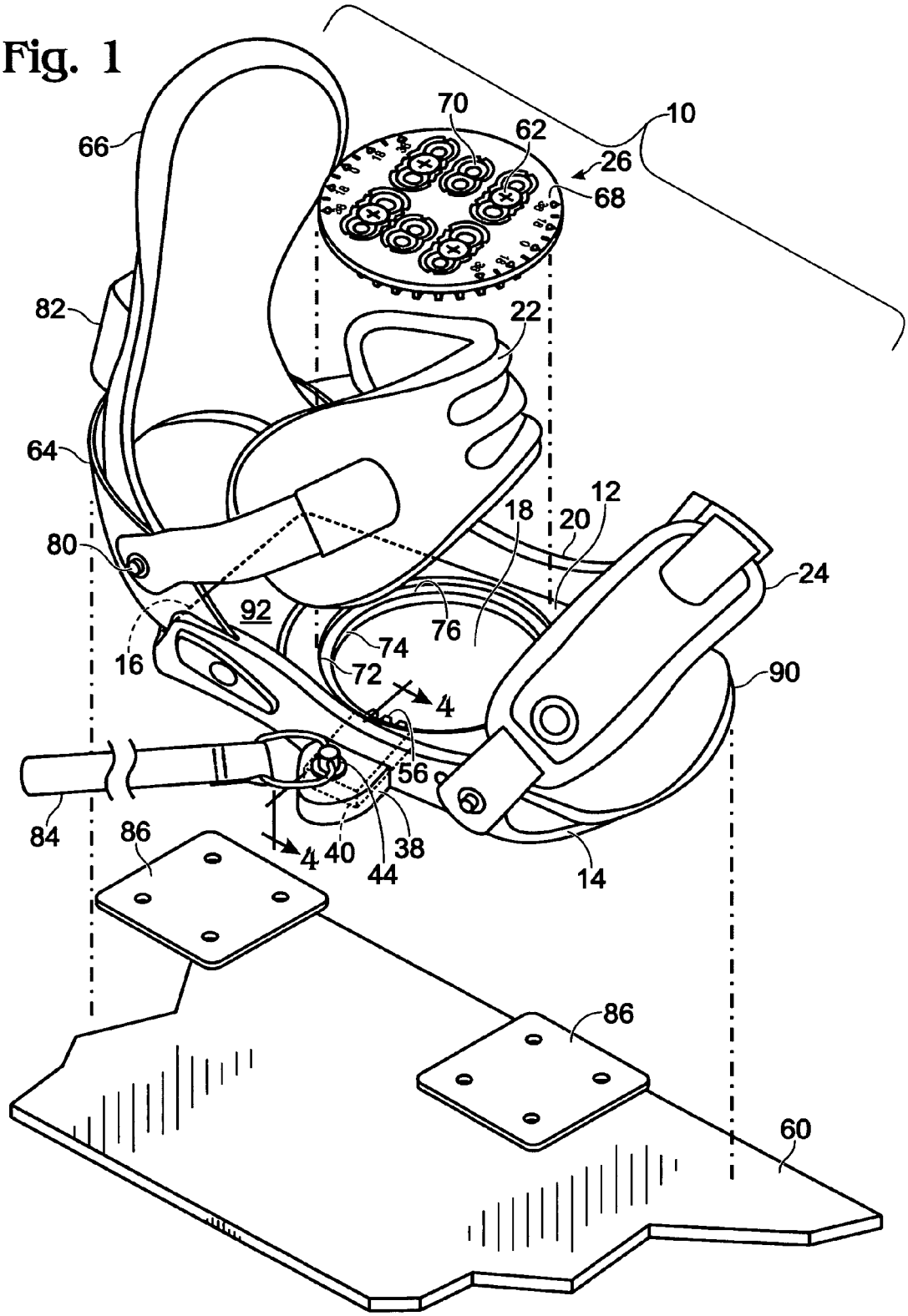
FIG. 1 shows an embodiment of the invention as it is being attached to a snowboard.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As shown in FIGS. 1-4, a rotatable snowboard boot binding 10 is provided. A boot binding 10 is attachable to a snowboard 60 through engaging plate attachment holes 70 with screws 62. As shown in FIGS. 1-4, a rotatable snowboard boot binding 10 includes a boot plate 12 with a toe end 14, a heel end 16, and an aperture 18, vertical supports 20, a boot binder which includes an upper binding strap 22 and a lower binding strap 24, an engaging plate 26 including a top portion 28 with a perimeter edge 30 and indices 68, a bottom portion 32 with a perimeter edge 34, the bottom portion perimeter edge 34 including engagement slots 36, and a latching device 38 which fits within a cutout 40 in boot plate 12 and engages engagement slots 36. Latching device 38 includes latch springs 42*a* & *b*, latch pin 44 with an upper end 46, a lower end 48, and a flange 50, a chain 52, a latch key 54 with teeth 56, and a latch cover 58. Boot binding 10 further includes a lower calf support 64 and an upper calf support 66 connected to boot binding 10. A tether 84 is connected to latch pin upper end 46 allowing the snowboarder to operate the device without having to bend down.

Figure 2:
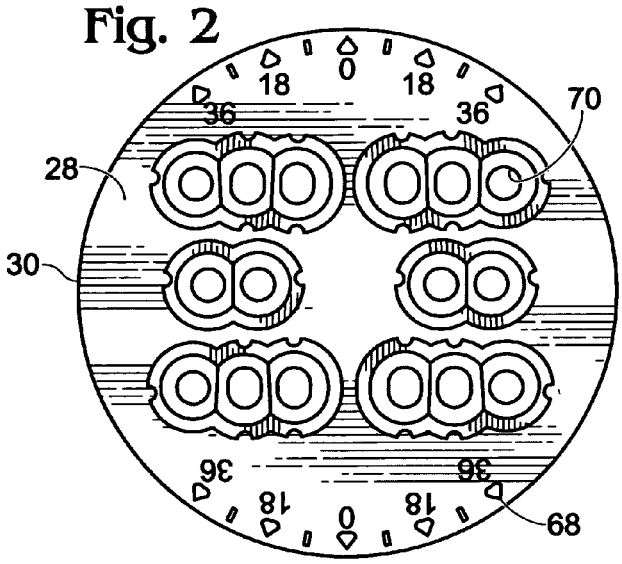
FIG. 2 shows a top view of an engaging plate top portion.
Figure 3:
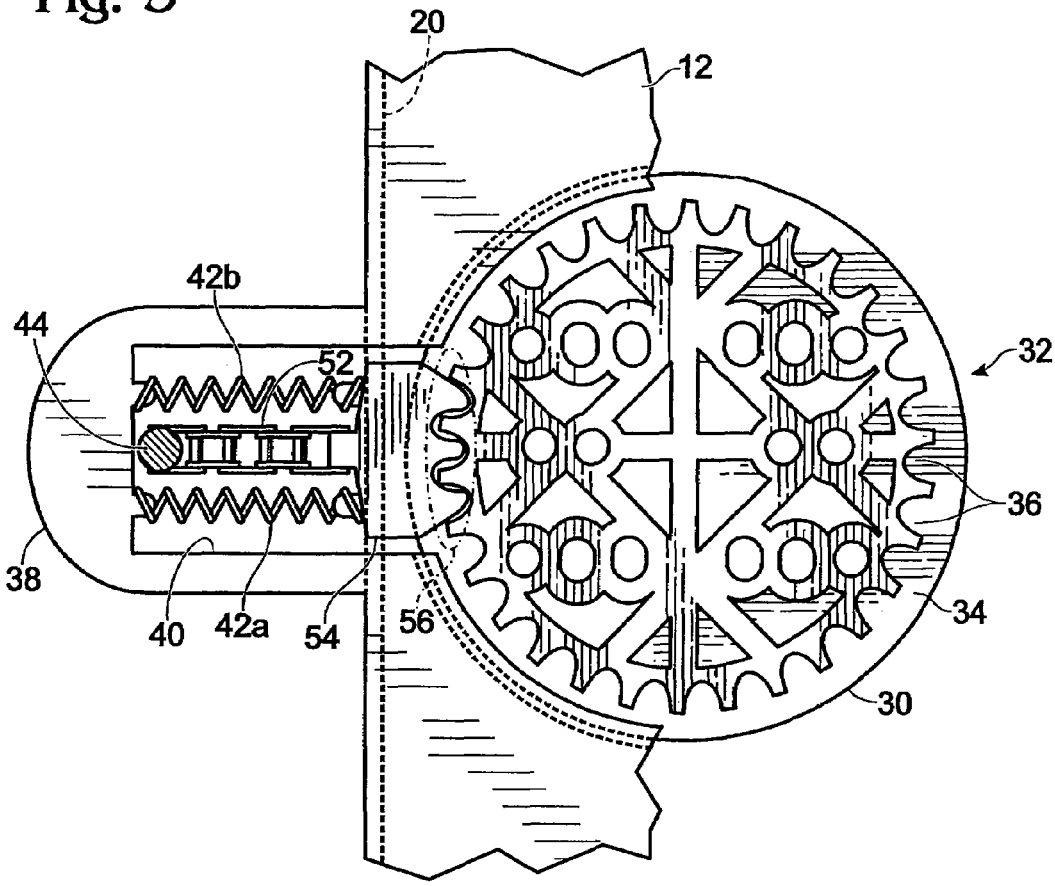
FIG. 3 shows a bottom view of an engaging plate bottom portion, with a latching device.

As shown in FIGS. 2 & 3, in a preferred embodiment an engaging plate 26 has a top portion 28 and a bottom portion 32. The top portion perimeter edge 30 overhangs bottom portion perimeter edge 34 in order retain rotatable boot binding 10 in contact with a snowboard 60. Engaging plate top portion and bottom portion are preferably round for ease of manufacturing, but non-circular arrangements are also possible. For instance, bottom portion 32 could be round, with top portion 28 elongated to provide more overlap at the forward and aft ends than along the elongated lateral edges, providing greater stiffness in the long axis of the snowboard boot. In another alternative, bottom portion 32 could comprise spokes radiating from the center rather than a continuous perimeter edge. A further alternative might include a polygonal shape, with engaging slots at the intersections of the outer surfaces. Other alternative shapes might be utilized as well and still fall within the invention. Non-continuous distribution of engagement slots 36 could also be used, the disadvantage being a more limited range of adjustments.

Engaging plate 26 includes attachment holes 70. Attachment holes 70 are distributed to provide attachment points for existing snowboards, as well as to accommodate desired offset or other adjustments by the snowboarder. Attachment holes 70 are countersunk to provide a flush top surface. Attachment screws 62 are provided, preferably Phillips head stainless steel screws, but any fastener style could be used. Indices 68 are provided on the top portion of engaging plate 26 for easy reference. Engaging plate 26 is preferably made from high strength plastic for light weight and low cost, but may be made from any suitable material, including aluminum, coated steel, or stainless steel, and any suitable manufacturing method, such as injection molding, pressing, forging, machining, etc. Attachment screws 62 are preferably made from stainless steel or black oxide coated steel, but any suitable material may be used including aluminum or high strength plastic. Indices 68 may be printed with ink, paint, or molded in relief, in any convenient increments.

Figure 4:
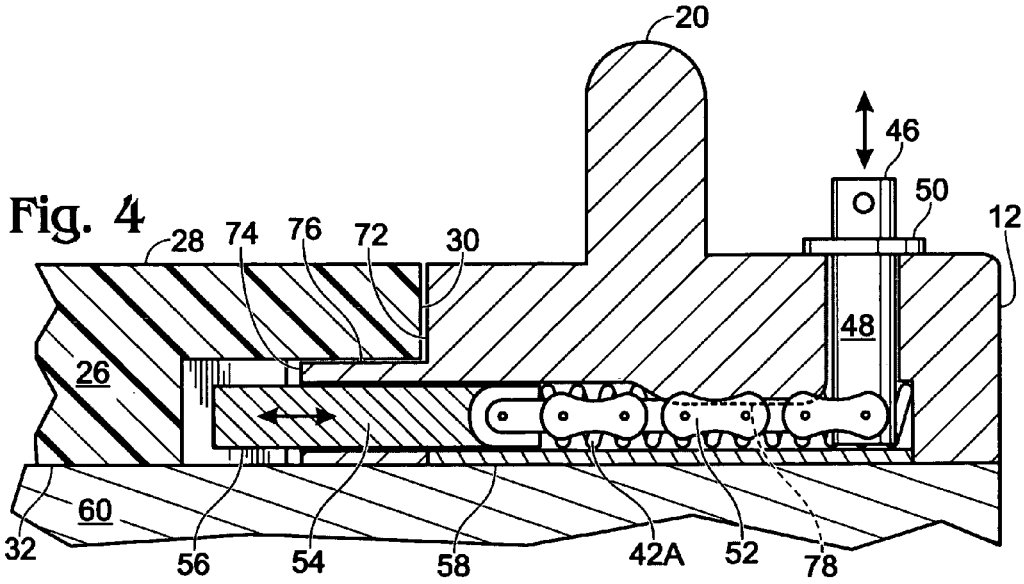
FIG. 4 shows a cut-away view of a latching device.

As shown in FIGS. 1 & 4, in a preferred embodiment engaging plate 26 is of stepped construction. Boot plate 12 includes counterbored aperture 18 which with an outer bore 72, an inner bore 74, and an aperture ledge 76. The counterbore construction allows the overhanging engaging plate top portion 28 to compress aperture ledge 76 to hold boot binding 10 in place, but does not rise far above boot plate 12 to interfere with the snowboarder's boot. Alternatively, aperture 18 could be constructed with smooth walls, in which case toe end 14 and heel end 16 can be made thicker to prevent interference from engaging plate 26. In another alternative, aperture 18 could be countersunk, with engaging plate 26 constructed in a beveled shape to insert into aperture 18. Boot plate 12 may be made from high strength plastics, aluminum, steel, or any other suitable material, using any suitable manufacturing method, such as injection molding, pressing, forging, machining, etc. A thin friction reducing pad 86 may be attached on the bottom side of boot plate 12, using flush fasteners (not shown). Such pad may made from self-lubricating polymer plastic such as nylon or acetyl resin (sold by E.I. du Pont de Nemours and Company of Delaware under the trade name Delrin™). Other low-friction materials may used as well, such as polytetrafluoroethylene (PTFE), perfluoroalkoxy polymer resin (PFA), fluorinated ethylene-propylene (FEP), polyoxymethylene, acetyl resin, high molecular weight polyethylene (HMWPE), or ultra-high molecular weight polyethylene (UHMWPE). Fasteners may be threaded, rivets, or any other suitable means and material. Pad 86 may also be comprised of a plurality of patches distributed on the bottom surface of boot plate 12.

As shown in FIGS. 1 & 4, latching device 38 is provided to lock in place rotatable boot binding 10. In a preferred embodiment, latching device 38 includes a latching device pin 44, with a pin upper end 46, pin lower end 48, and pin flange 50. Pin lower end 48 connects to chain 52. Chain 52 connects pin 44 to latch key 54, and latch key 54 includes latch key teeth 56 which insert into engagement slots 36 on engaging plate 26 to prevent boot binding 10 from rotating. Alternatively, chain 52 could be a cable, cord, ribbon, or flexible strip. Raised bearing race 78 acts as a guide for chain 52 as well as a bearing surface. Latch springs 42*a* & *b* exert force to positively engage latch key teeth 56 with engagement slots 36. Alternatively, latching device 38 could include a single latch spring or a plurality of latch springs, acting in tension or compression. Latching device 38 fits within cutout 40, and latching device cover 58 protects and contains latching device 38. Pin upper end 46 connects to tether 84 which can be attached to the snowboarder's leg to allow easy operation. Latch key 54, chain 52, latch springs 42*a* & *b*, and latch pin 44 are preferably made with stainless steel for strength and corrosion resistance, but any suitable material may be used, such as high strength plastic, aluminum, or oxide coated steel, and any suitable manufacturing method. Alternatively, latching device 38 could include an engaging bar inserted across latch key 54 within cutout 40, with a tension bar inserted through latch key 54. Pulling on tether 84 would leverage latch key 54 against the tension bar, thereby disengaging teeth 56 from engagement slots 36, allowing the boot binding 10 to rotate.

As shown in FIG. 1, in a preferred embodiment vertical support 20 rises along the lateral edges of boot plate 12 to provide lateral support for the snowboarder's foot. Lower calf support 64 adds further support for the snowboarder's foot, and is preferably adjustably connected to vertical support 20, in order to accommodate differing boot sizes. Alternatively, lower calf support 64 may be rigidly connected to vertical support 20. In another alternative boot plate 12, vertical supports 20 and lower calf support 64 may be molded as a single piece, to provide stronger support or to reduce manufacturing costs. Upper calf support 66 is preferably connected to lower calf support 64 through an articulated joint 80 which provides flexible support. Rearward overextension is prevented by stopper 82. Vertical supports 20 are preferably formed with boot plate 12 as one piece from high strength plastic, but other materials and methods may be used. Lower calf support 64 is preferably made from stainless steel or aluminum for high tensile strength and durability, but other materials such as high strength plastic may be used. Upper calf support 66 is preferably made from molded plastic to allow some flexion, but any suitable material may be used.

Toe end 14 and heel end 16 are provided with raised pads 90 and 92, respectively, to provide positive capture for the snowboarder's boot and clearance for engaging plate 26. Preferably both are adjustably mounted pads so as to accommodate differing boot sizes, but they may be formed as part of boot plate 12 in order to reduce manufacturing costs. A boot binder preferably includes an upper binding strap 22 and a lower binding strap 24, which may be any commonly available style of strap. More or fewer binding straps may be used. Alternatively, a boot binder may include boot clamps, or a combination of binding straps and boot clamps. Wide padded webbing may be added to binding straps 22 and 24 to prevent the straps from twisting and fraying.

In operation in one embodiment, referring to FIGS. 1-4, a rotatable snowboard boot binding 10 is attached to snowboard 60 with screws 62 through attachment holes 70 in engaging plate 26, so that engaging plate top portion perimeter edge 30 compresses down against aperture ledge 76 to hold boot binding 10 firmly. Latch key teeth 56 fit snugly into engaging slots 36 along engaging plate bottom portion perimeter edge 34 to lock boot binding 10 and prevent rotation. A snowboarder may adjust the angle of boot binding 10 by pulling on tether 84 to lift latching device pin 44, thereby pulling chain 52 and compressing latch springs 42*a* & *b*. Chain 52 slides along raised bearing race 78, thereby sliding latch key 54 within boot plate cutout 40 until latch key teeth 56 are clear of engagement slots 36 and boot binding 10 is free to rotate in relation to snowboard 60. Indices 68 make adjustment to the proper angle easy. When boot binding 10 is adjusted to the proper angle the snowboarder simply releases tension on tether 84, allowing latch springs 42*a* & *b* to decompress and drive latch key 54 toward engaging plate 26 and engaging latch key teeth 56 in engagement slots 36 to prevent rotation of boot binding 10.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A rotatable snowboard boot binding, comprising:

a boot plate with a toe end, a heel end, an aperture, and a cutout;

a vertical support connected to said boot plate;

a boot binder;

an engaging plate, comprising a top portion with a perimeter edge, a bottom portion, and attachment holes, said bottom portion comprising a perimeter edge with engagement slots, wherein said top portion perimeter edge overhangs said bottom portion perimeter edge;

a latching device fitting moveably within said cutout in said boot plate and engageable with one or more engagement slots in said engaging plate;

wherein the aperture in said boot plate comprises a circular counterbore with an inner bore, an outer bore, and a ledge, wherein the inner bore diameter is approximately equal to the maximum breadth of the bottom portion of the engaging plate but less than the maximum breadth of the top portion of the engaging plate at each point, and the outer bore diameter is equal to or greater than the maximum breadth of the engaging plate top portion at each point.

2. The rotatable snowboard boot binding of claim 1, further comprising a tether attached to said latching device for operating said latching device.

3. The rotatable snowboard boot binding of claim 2, wherein the tether is attachable to snowboarder's leg for standing access.

4. The rotatable snowboard boot binding of claims 1, further comprising a soft plastic pad connected to the bottom surface of said boot plate.

5. The rotatable snowboard boot binding of claim 4, wherein the soft plastic pad is made from self lubricating polymer plastic.

6. The rotatable snowboard boot binding of claim 4, wherein the soft plastic pad is made from material selected from the group consisting of nylon, acetal resin, polytetrafluoroethylene, perfluoroalkoxy polymer resin, fluorinated ethylene-propylene, polyoxymethylene, acetyl resin, high molecular weight polyethylene, or ultra-high molecular weight polyethylene.

7. The rotatable snowboard boot binding of claim 1, wherein the engaging plate is formed as a single piece.

8. The rotatable snowboard boot binding of claim 1, wherein the engaging plate top portion and bottom portion are circular and concentric in relation to one another.

9. The rotatable snowboard boot binding of claim 1, wherein said engaging plate is made with materials selected from the group of high strength plastic, aluminum, stainless steel, or oxide coated steel.

10. The rotatable snowboard boot binding of claim 1, wherein the boot plate toe end and heel end comprise raised areas.

11. The rotatable snowboard boot binding of claim 1, wherein the boot plate toe end and heel end comprise pads adjustably connected to said boot plate.

12. The rotatable snowboard boot binding of claim 1, wherein said boot binder includes one or more binding straps.

13. The rotatable snowboard boot binding of claim 1, wherein said boot binder includes a plurality of boot clamps.

14. The rotatable snowboard binding of claim 1, further comprising a lower calf support connected to said vertical support, and an upper calf support connected to said lower calf support.

15. The rotatable snowboard boot binding of claim 14, wherein said lower calf support is adjustably connected to said vertical support.

16. The rotatable snowboard boot binding of claims 14, wherein said upper calf support is connected to said lower calf support using an articulated joint.

17. The rotatable snowboard boot binding of claims 14, wherein the material of said lower calf support is selected from the group consisting of aluminum, stainless steel, and oxide coated steel.

18. The rotatable snowboard boot binding of claim 1, wherein said latching device comprises:

a latch key fitting slidably within said cutout in said boot plate with at least one tooth for engaging said engagement slots in said engaging plate;

a pin; and spring means for positively seating said latch key using spring force; and, connecting means for connecting the latch key to the pin;

wherein displacing said pin causes said latch key to slidingly disengage from said engagement slots, thereby deforming said spring means, and further wherein releasing said pin allows said latch key to reengage said engagement slots due to spring force.

19. The rotatable snowboard boot binding of claim 18, wherein said latching device connecting means includes a sprocket chain.

20. The rotatable snowboard boot binding of claim 19, wherein said sprocket chain rides upon a raised bearing race within said cutout.

21. The rotatable snowboard boot binding of claims 18, wherein said spring means includes a linear coil spring within said cutout in said boot plate, and in parallel with said latch key.

22. The rotatable snowboard binding of claim 1, wherein said latching device comprises:

a latch key fitting movably within said cutout in said boot plate, with at least one tooth for engaging said engagement slots in said engaging plate;

an engaging bar inserted within said cutout in said boot plate, wherein the engaging bar fits across and over said key;

a tension bar inserted through said key and into a slot in said boot plate;

a pin with a first end and a second end, wherein said first end is connected to the non-engaged end of said engaging bar; and a tether attached to said second end of said pin.

23. The rotatable snowboard boot binding of claims 18 or 22, wherein said latch key includes a plurality of teeth.

24. A snowboard with a rotatable snowboard boot binding, comprising:

a snowboard;

a boot plate with a circular aperture and a slot disposed along a lateral edge of said boot plate and in communication with said circular aperture;

a toe pad adjustably connected to said boot plate;

a heel pad adjustably connected to said boot plate;

lateral vertical supports connected to said boot plate;

a boot binder for binding a snowboard boot into said rotatable boot binding;

an engaging plate, comprising a circular bottom portion with a perimeter edge including engagement slots distributed along said perimeter edge and diameter less than said aperture in said boot plate, a circular top portion greater in diameter than said aperture in said boot plate and concentric with said bottom portion, and attachment holes passing through said bottom and top portions;

attachment screws for attaching said engaging plate to said snowboard;

a spring loaded latching device fitting slidably within said slot in said boot plate and engageable with one or more engagement slots in said engaging plate; and a tether connected to said latching device for operating said latching device from a standing position.

25. The snowboard with a rotatable boot binding of claim 24, wherein said aperture comprises a circular counterbore with an inner bore, an outer bore, and a ledge, wherein the inner bore diameter is approximately equal to the maximum breadth of the bottom portion of the engaging plate but less than the maximum breadth of the top portion of the engaging plate at each point, and the outer bore diameter is equal to or greater than the maximum breadth of the engaging plate top portion at each point.

* * * * *